United States Patent [19]

Katsumata

[11] 3,937,190

[45] Feb. 10, 1976

[54] IGNITION TIMING CONTROLLER FOR A BREAKERLESS IGNITION SYSTEM

[75] Inventor: Mitsuo Katsumata, Numazu, Japan

[73] Assignee: Kokusan Denki Co., Ltd., Tokyo, Japan

[22] Filed: Oct. 10, 1973

[21] Appl. No.: 404,870

[30] Foreign Application Priority Data

Oct. 12, 1972 Japan ..... 47-101549
Oct. 19, 1972 Japan ..... 47-120042[U]

[52] U.S. Cl. ..... 123/117 R; 123/148 E
[51] Int. Cl.[2] ..... F02P 5/04
[58] Field of Search ..... 123/148 E, 148 MC, 117 R

[56] References Cited

UNITED STATES PATENTS

| | | | |
|---|---|---|---|
| 3,405,347 | 10/1968 | Swift | 123/148 MC |
| 3,524,438 | 8/1970 | Janisch | 123/148 MC |
| 3,661,132 | 5/1972 | Farr | 123/148 MC |

*Primary Examiner*—Charles J. Myhre
*Assistant Examiner*—Ronald B. Cox
*Attorney, Agent, or Firm*—Watson Leavenworth Kelton & Taggart

[57] ABSTRACT

An ignition timing controller for a breakerless ignition system in use for an internal combustion engine, comprising a semiconductor switching means to control a primary current of an ignition coil and a signal source to supply a control signal to said semiconductor switching means, said signal source including a plurality of signal generators to generate signal voltages having phase difference between one and another in timing with rotation of said engine. Voltage composing means is provided which selectively composes the signal voltages from said respective signal generators at a selected ratio of one to another and which supplies said control signal to said semiconductor switching means.

3 Claims, 14 Drawing Figures

IGNITION TIMING CONTROLLER FOR A BREAKERLESS IGNITION SYSTEM

FIELD OF THE INVENTION

This invention relates to an ignition timing controller for an ignition system in use for an internal combustion engine, and more particularly to an ignition timing controller for an ignition system comprising a semiconductor switching means to control a primary current flowing through an ignition coil and a signal generator to supply a control signal to a semiconductor switching means.

BACKGROUND OF THE INVENTION

Since an internal combustion engine has its torque characteristics and composition of exhaust gas variable with ignition timing, it is lately required to widely adjust the ignition timing in an optimum manner or in association with the opening and closure of a throttle valve to provide characteristics suited to the operating condition of the engine. In an internal combustion engine employed for a motor boat, for example, the ignition timing has been often varied by an angle of approximately 30° to 40° where trolling is desired to be effected or where the deceleration is abruptly effected. One of the prior art ignition systems adapted to widely adjust the ignition timing of the engine is of type having a generator connected by a linkage or any other means to the crank shaft of the engine for rotation therewith. However, such prior art system requires not only substantial force to displace the generator on adjustment of the ignition timing, but also the high precision of a mechanical adjusting mechanism for the linkage. With the system having such mechanical adjusting mechanism, various situations tend to occur in which the ignition timing is shifted and in which the smooth operation is obstructed due to rust on the mechanically engaging portions of the linkage or to foreign matter deposited thereon.

SUMMARY OF THE INVENTION

Accordingly, it is an object of the present invention to provide an ignition timing controller for a breakerless ignition system for use in an internal combustion engine adapted to widely and electrically adjust the ignition timing of the engine.

In accordance with the present invention, there is provided an ignition timing adjusting apparatus for an ignition system for use in an internal combustion engine, comprising a semiconductor switching means to control a primary current flowing through an ignition coil and a signal source to supply a control signal to said semiconductor switching means, characterized by said signal source including a plurality of signal generators to generate signal voltages having phase difference between one and another in timing with the rotation of said engine and voltage composing means connected to the outputs of said plurality of signal generators to selectively compose the signal voltages from said signal generators at a selected ratio of one of the voltages to the other voltages, said voltage composing means having its output voltage applied across the controlled electrodes of said semiconductor switching means.

In a typical embodiment of the present invention, the signal generators comprise respective generating coils spacedly angularly disposed in a flywheel type magneto driven by the crank shaft of the engine. The two generating coils have first ends connected to a common point and grounded to earth and the other ends connected through respective diodes to a variable voltage divider or resistor, which has a dividing terminal connected to one of the controlled electrodes of the semiconductor switching means to control the primary current flowing through the ignition coil.

With the above-mentioned apparatus of the present invention, the control signal to be applied across the controlled electrodes of the semiconductor switching means can be varied in phase difference within the range of the maximum phase difference angle of $\theta°$ by varying the divided ratio of the variable divider. Since the maximum phase difference of $\theta°$ can be easily varied by properly selecting the angular spacing of two generating coils disposed in the flywheel type magneto, it is possible to widely adjust the ignition timing of the engine as desired.

According to the embodiment of the present invention, since the ignition timing is adjusted by varying the divided ratio of the variable divider, the fine adjustment of the ignition timing can be effected in a stabler and smoother manner compared to the prior art wherein the signal generator itself is mechanically moved and because of no presence of any mechanically movable parts the trouble caused by the foreign matter attached thereto, the occurence of the rust and the vibration on the parts can be effectively prevented.

According to the embodiment of the present invention, the dividing terminal of the variable divider can be easily associated with the degree of opening of a throttle valve in the engine or with an accelerating pedal or an accelerating grip of the engine for an autobicycle. This is important for adjusting the ignition timing of the engine through a simple manipulation by the operator.

Alternatively, the signal composing means may comprise a transformer having a movable core so that the output voltages from the signal generators are composed at a selected ratio of one of the voltages to the other voltage. The output voltages from the signal generators are applied across respective coils of the transformer associated with the respective signal generators and another coil of the transformer has an output voltage induced from the aforementioned coils in phase dependable upon the position of the movable core magnetically coupled with the three coils. The second embodiment of the present invention has the same effect as that of the first embodiment.

BRIEF DESCRIPTION OF THE DRAWINGS

The above and other objects and features of the present invention will become apparent from the reading of the preferred embodiments of the present invention taken with reference to the accompanying drawings.

Figure 7:
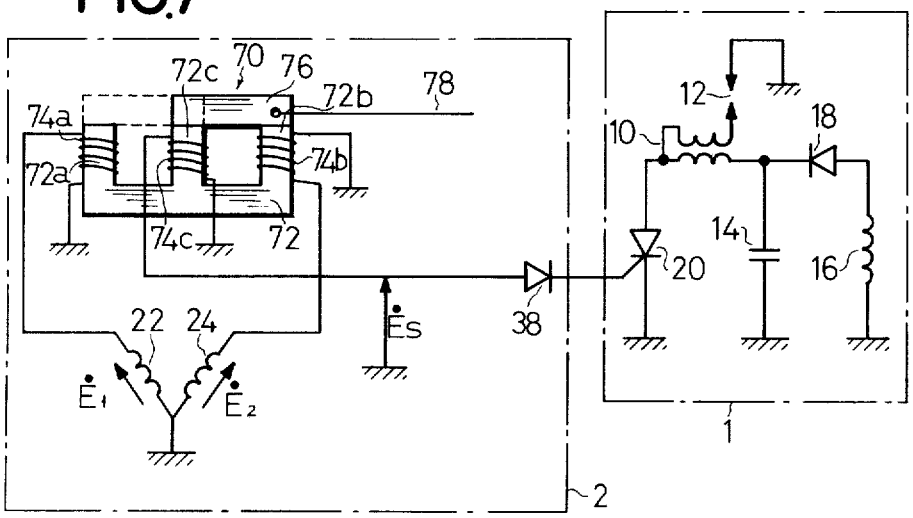
FIG. 7 shows a circuit of another embodiment of the present invention.
Figure 8A:
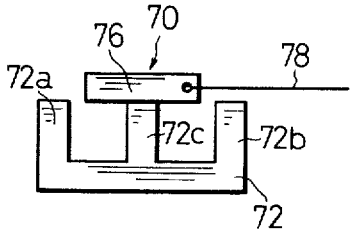
FIGS. 8A and 8B illustrate a movable core transformer employed in the embodiment shown in FIG. 7 and operated in different conditions.
Figure 8B:
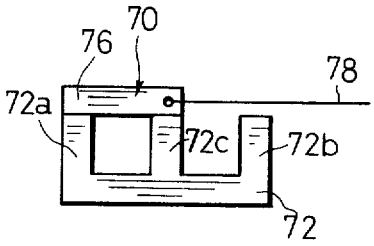
Figure 9A:
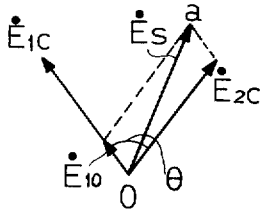
Figure 9B:
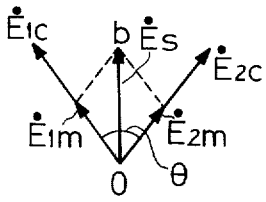
Figure 9C:
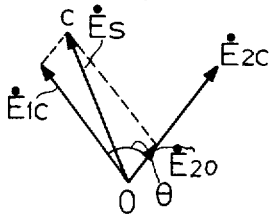
Figure 10:
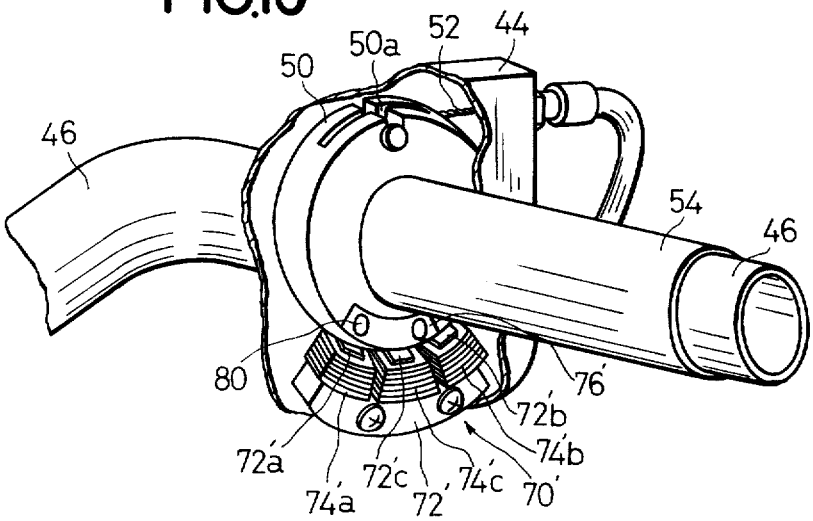

FIGS. 9A to 9C show vectorial graphs illustrating the relationship between the inputs and output of the transformer shown in FIGS. 7, 8A and 8B when the movable core is in various positions, respectively; and FIG. 10 is a perspective view of an accelerating grip with the transformer incorporated thereinto, with a portion broken away for illustration.

DETAILED DESCRIPTION OF THE PREFERRED EMBODIMENT

Figure 1:
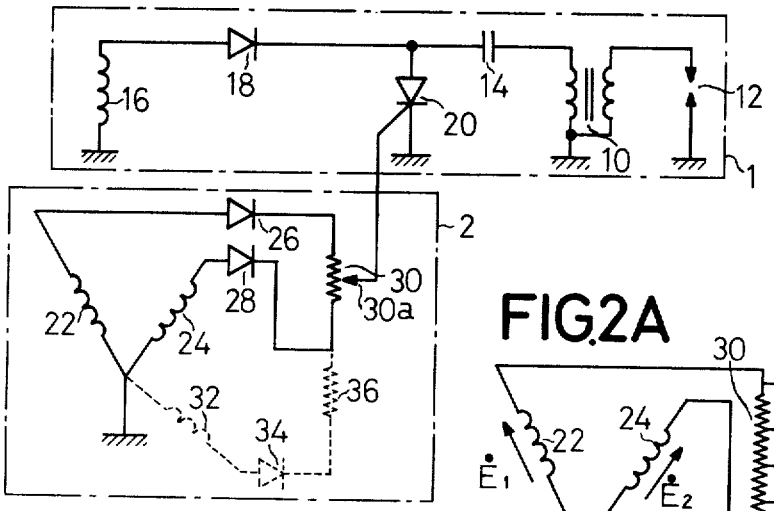
FIG. 1 shows a circuit of one embodiment of the present invention.

Referring now to FIG. 1, there is shown a typical embodiment of the present invention wherein a variable dividing resistor is employed as voltage composing means to selectively compose output voltages from a plurality of signal generators incorporated in a signal source. In this figure, reference numeral 1 designates a conventional breakerless ignition system and reference numeral 2 a signal source, which constitutes a feature of the present invention, to supply a control signal to the above-mentioned breakerless ignition system.

The breakerless ignition system 1 comprises an ignition coil 10, an ignition plug 12 connected to the secondary side of the ignition coil 10, a capacitor 14 connected to the primary side of the ignition coil 10, a capacitor charging supply source 16 to charge the capacitor 14 through a diode 18 and the primary side of the ignition coil 10 and semiconductor switching means 20, such as a thyristor. At ignition period, the semiconductor switching means 20 is supplied at the controlled electrodes thereof with a control signal to make it conductive to thereby discharge the capacitor 14 through the primary coil of the ignition coil 10 for discharge through the ignition plug 12.

The signal source 2 comprises two signal generators 22 and 24 to generate signal voltages of different phases from each other in timing with rotation of the engine. In the illustrated embodiment, the signal generators at one ends thereof are commonly connected to earth. Such signal generators may comprise two generating coils, respectively, spacedly angularly disposed within a flywheel magneto which is driven by the crank shaft of the engine. The other ends of the signal generators are connected through respective diodes 26 and 28 to a variable dividing resistor 30, the dividing terminal 30*a* of which is connected to a controlled electrode of the semiconductor switching means 20. The variable dividing resistor may comprise a conventional sliding resistor having a brush or a variable resistor having a movable contact to be switched from one of the taps to another. In the signal source circuit shown in FIG. 1, the diodes 26 and 28 connected in series to the generating coils 22 and 24, respectively serve to prevent recirculating current through the two generating coils and also to protect the semiconductor switching means from the reverse voltage across the gate and cathode of the semiconductor switching means. But, provided the above phenomena is negligible, the diodes 26 and 28 may be eliminated.

Figure 2A:
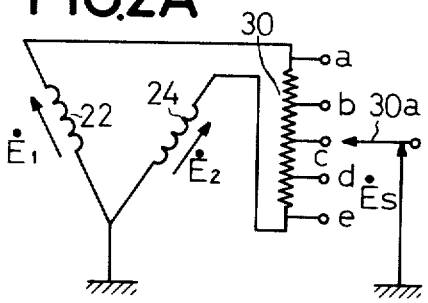
FIG. 2A shows a circuit of a signal source shown in FIG. 1.
Figure 2B:
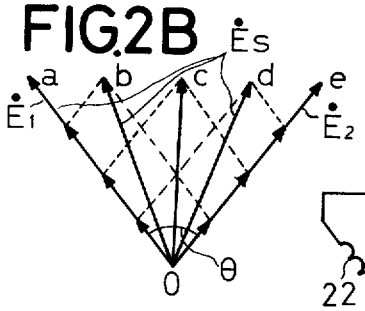
FIG. 2B shows a vector of the signals of the signal source shown in FIG. 2A.

With the above-mentioned construction, the control signal can be varied in phase by varying the divided ratio of the variable dividing resistor. More particularly, assuming the signal generators generate voltages $\dot{E}_1$ and $\dot{E}_2$ (FIG. 2B) having a phase difference, voltage $\dot{E}_s$ across the dividing terminal 30*a* and the commonly connected point of the signal generators 22 and 24 that vectorially composed of voltages $\dot{E}_1$ and $\dot{E}_2$ from the respective signal generators. By way of example, in case where the dividing terminal 30*a* is selectively engaged with the tap *a* (FIG. 2A) of the resistor 30, $\dot{E}_s$ equals $\dot{E}_1$ and in case where the dividing terminal 30*a* is selectively engaged with the middle tap *c* of the resistor, $\dot{E}_s$ equals to $(\dot{E}_1 + \dot{E}_2)/2$. Thus, as the dividing terminal 30*a* moves sequentially from the tap *a* to *e* to be engaged with one of them, voltage $E_s$ varies from $\overrightarrow{oa}$ to $\overrightarrow{oe}$ as shown in FIG. 2B so that the ignition timing can be shifted within the range of angle $\theta$.

While the above description has been made in connection with two signal generators, an additional signal generator 32 to generate signal voltage of phase different from those from the signal generators 22 and 24 may be provided, one end of which is commonly connected to earth together with the said one ends of the signal generators 22 and 24 and the other end of which is connected through a diode 34 and a resistor 36 to a connection point of the diode 28 and the variable dividing resistor 30, so that the ignition timing can be more widely adjusted. If the resistor 36 comprises an extension of the variable dividing resistor 26, further wider range of the adjustment will be provided.

Figure 3:
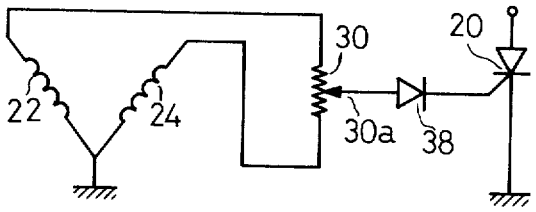
FIGS. 3 through 5 partially show modifications of the embodiment shown in FIG. 1.

While the diodes are disposed between the respective signal generators and the dividing resistor 30 in the embodiment of FIG. 1, a single diode 38 may be disposed between the dividing terminal 30*a* and the associated controlled electrode of the semiconductor switching means 20 as shown in FIG. 3.

Figure 4:
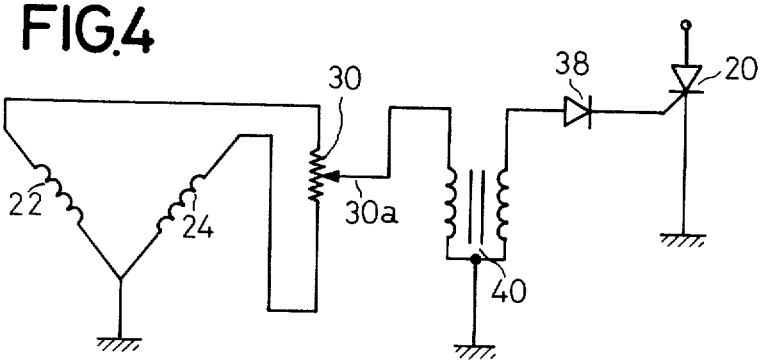

As shown in FIG. 4, a signal transformer 40 may be further disposed between the dividing terminal 26*a* and the diode 38 of FIG. 3 so that the phase of primary energization of the transformer 40 varies. The arrangement shown in FIG. 4 has the same effect as those of FIGS. 1 and 3.

Figure 5:
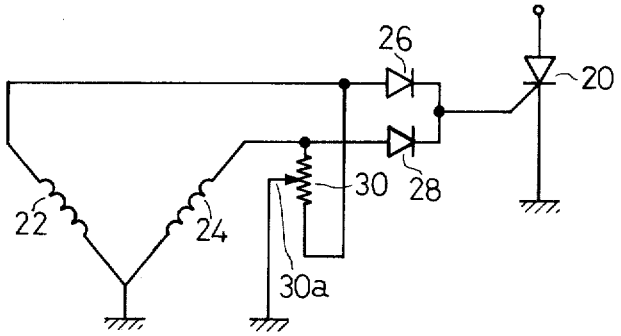

Also, as shown in FIG. 5, the remote ends of the signal generators 22 and 24 from the grounded ends thereof may be alternatively connected through the respective diodes 26 and 28 to the controlled electrode of the semiconductor switching means 20 and the dividing terminal of the dividing resistor 30 may be connected to the common point of the signal generators 22 and 24.

It will be noted that the dividing terminal 30*a* of the variable dividing resistor 30 may be separately adjusted or if necessary, associated with movement of a throttle of the engine.

It should be understood that the invention will be capable of being applied to a breakerless ignition system of other type, such as one which comprises a semiconductor switching means, such as transistor adapted to break off a primary current flowing through a primary coil of an ignition coil whereby a secondary coil has high voltage established thereacross. Accordingly, the semiconductor switching means includes all of controlled semiconductor switching means, such as thyristor, transistor and gate turned off thyristor (GTO).

Figure 6:
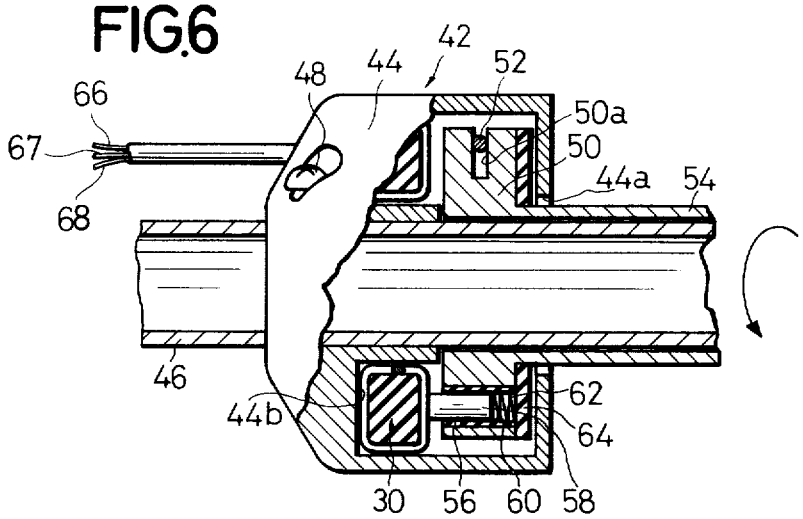
FIG. 6 illustrates in partial section an accelerating grip into which a voltage divider is incorporated.

In FIG. 6 there is shown an accelerating grip 42 for an autobicycle into which the variable dividing resistor 30 is incorporated in association with the accelerating grip for variation in the dividing ratio of the resistor 30. The accelerating grip 42 comprises a grip cover 44 secured to a handle body 46 of the autobicycle adjacent to the distal end thereof by means of a screw 48 extending through the cover 44 and threaded into the handle body. Within the grip cover 44 is rotatably mounted around the handle body 46 a disk-like rotor 50, which is provided with a peripheral groove 50*a* receiving a throttle wire 52 associated with a throttle valve in a carburetor (not shown). The rotor 50 is also provided at the rear face thereof with a tubular grip operating member 54 axially extending from the rotor 50 through the hole 44*a* along the handle body 46 for manipulation of the rotor 50. Thus, rotation of the grip operating member 54 causes the throttle wire 52 to be pushed or drawn to thereby close and open the throttle valve in the carburetor.

The variable dividing resistor 26, which is of ring-like winding type sliding rheostat, is disposed in a facing relation with the rotor 50 within the grip cover 44. The rheostat comprises a resistance wire wound around a ring-like insulation and may be secured to the inner wall 44*b* of the grip cover 44 by any suitable means. The rotor 50 may be provided in a facing relation with the rheostat 26, with a recess 56 in which an electric brush 58, such as carbonic brush or metallic brush engaging the body of the rheostat, is received in an insulated relation with the rotor 50 by a cylindrical insulation 60. The electric brush 58 is urged by a coil spring 62 received behind the brush in the recess 56 with the coil spring 62 at the rear end thereof bearing against an insulating plate 64 secured to the rotor 50, so that the electric brush 58 is engaged against the rheostat body in a suitable pressure. The rheostat 30 at the both ends thereof is connected to the respective signal generators 22 and 24 as shown in FIG. 1 through respective leads 66 and 68 and the electric brush 58 is connected to one of the controlled electrodes of the semiconductor switching means 20 through a lead 67. Thus, when the grip operating member 54 is rotated for adjustment of the throttle valve to a desired degree of opening, the electric brush on the rotor 50 is caused to slide on the resistance wire of the rheostat 30 to thereby apply a control signal of the dividing ratio corresponding to variation in the degree of opening of the throttle valve, across the controlled electrodes of the semiconductor switching means for adjustment of the ignition timing.

Referring now to FIG. 7, there is shown a modification of the present invention wherein a movable core transformer 70 is employed as the voltage composing means to selectively compose the output voltages from the plurality of the signal generators at any ratio. The same components are designated by the same numerals as those of FIG. 1. The transformer 70 comprises an E-shaped stationary core 72 including three leg portions 72*a* to 72*c* and coils 74*a* to 74*c* wound around the three leg portions 72*a* to 72*c*, respectively. The coils 74*a* and 74*b* on the side leg portions 72*a* and 72*b* are used as input coils with the one ends connected to the outputs of the signal generators 22 and 24 and with the other ends grounded to earth. The coil 74*c* on the middle leg portion 72*c* is used as on output coil with the one end connected to one of the controlled electrodes of the semiconductor switching means 20 through the diode 38 and with the other end grounded to earth. A movable core 76 is slidably disposed on the top of the E-shaped core 72 and has sufficient length to magnetically couple the adjacent leg portions of the core 72. The movable core 76 may be associated with an operating rod 78 to operate the throttle valve in the carburetor so that the movable core 76 slidably moves on the top ends of the leg portions 72*a* to 72*c*.

Vector diagrams of FIGS. 9A, 9B and 9C show variations in voltages $\dot{E}_{1c}$, $\dot{E}_{2c}$ and $\dot{E}_s$ induced in the coils 74*a*, 74*b* and 74*c*, respectively when the movable core 76 is positioned at the points shown in FIGS. 7, 8A and 8B, respectively in case where voltages $\dot{E}_{1c}$ and $\dot{E}_{2c}$ having phase difference of angle $\theta°$ are generated from two signal generators 74*a* and 74*b*. With the movable core 76 positioned as shown in FIG. 7, a closed magnetic circuit is provided between the leg portions 72*b* and 72*c* by the movable core 76 positioned across the leg portions 72*b* and 72*c*, resulting in high voltage $\dot{E}_{2c}$ induced in the coil 74*b* while an open magnetic circuit is provided between the leg portions 72*a* and 72*c*, resulting in low voltage $\dot{E}_{10}$ induced in the coil 74*a*. Accordingly, the voltage $\dot{E}_s$ induced in the coil 74*c* is composed of the composite vector $\vec{oa}$ of the voltages $\dot{E}_{10}$ and $\dot{E}_{2c}$.

With the movable core 76 positioned as shown in FIG. 8A, the movable core 76 engages only the middle leg portion 72*c* and is open relative to the side leg portions 72*a* and 72*b*, resulting in approximately equal voltages $E_{1m}$ and $E_{2m}$ induced in the coils 74*a* and 74*c*, respectively as shown in FIG. 9B. Accordingly, the voltage $\dot{E}_s$ induced in the coil 74*c* is composed of the composite vector ob of the voltages $E_{1m}$ and $E_{2m}$.

With the movable core 76 positioned as shown in FIG. 8B, the magnetic circuit between the leg portions 72*a* and 72*c* is closed while that between the leg portions 72*b* and 72*c* is open and as a result the voltage $\dot{E}_s$ induced in the coil 74*c* is composed of the composite vector $\vec{oc}$ of the voltage $\dot{E}_{1c}$ induced in the coil 74*a* and the voltage $\dot{E}_{20}$ induced in the coil 74*b* as shown in FIG. 9C.

Thus, the output voltage $\dot{E}_s$ of the coil 74*c* can be varied in phase within the angle of $\theta°$ by shifting the movable core 76 along the top of the core 72, so that the ignition timing of the engine can be adjusted with the voltage $\dot{E}_s$ supplied as a control signal to the semiconductor switching means 20.

Referring now to FIG. 10, there is illustrated an embodiment wherein the ignition timing controller of the movable core transformer type shown in FIG. 7 is applied to an autobicycle in the same manner as shown in FIG. 6. The same components as those of FIG. 6 are designated by the same reference numerals.

In this embodiment, the transformer 70' comprises the E-shaped stationary core 72' entirely in the form of an approximate arc including three leg portions 72'*a*, 72'*b* and 72'*c* having arcuate end faces securedly disposed in facing relation to the periphery of the rotor 50 integral with the grip operating member 54 within the grip cover 44. The side leg portions 72'*a* and 72'*c* have respective coils 74'*a* and 74'*c* would thereon with the one ends thereof commonly grounded and with the other ends thereof connected to the outputs of the signal generators 22 and 24 shown in FIG. 7, respectively through respective leads not shown.

The middle leg portion 72'*c* has the coil 74'*c* wound thereon with the one end thereof grounded and with the other end connected to one of the controlled electrodes of the semiconductor switching means 20 shown in FIG. 7, through a lead not shown. The transformer 70' also comprises arcuate movable core 76' secured to the rotor 50' by screws 80 so that the movable core 76' is faced with the leg portions of the stationary core 72' in a closely spaced manner.

Thus, when the grip operating member 54 is rotated for adjustment of the throttle valve the movable core 76' on the rotor 50 is caused to shift for variable magnetic coupling between the coils 74'*a* and 74'*b* relative to the output coil 74'*c*, resulting in the output voltage induced in the output coil corresponding to the degree of opening of the throttle valve. When the output voltage is supplied as a control signal to the semiconductor switching means at the controlled electrodes thereof, the ignition timing of the engine can be adjusted in response to the degree of opening of the throttle valve.

While some preferred embodiments of the invention have been described in connection with the accompanying drawings, it should be understood that various modifications and changes have been made without departing from the spirit of the invention, which has been defined only the appended claims.

What is claimed is:

1. An ignition timing controller for use in a breakerless ignition system for an internal combustion engine having a flywheel magneto, said controller comprising a semiconductor switching means to control a primary current through an ignition coil and a signal source to supply a control signal to said semiconductor switching means, characterized by that said signal source includes a plurality of signal generators to generate respective signal voltages having different phase angles, a voltage composing means comprising a variable dividing resistor having a dividing terminal, said signal generators at one end thereof being commonly grounded and at the other end thereof connected to the ends of said variable dividing resistor whereby the output voltages of said signal generators may be selectively combined at any ratio of one to another, a signal transformer having a primary side connected to said dividing terminal of said variable dividing resistor and a secondary side commonly grounded with said primary side and generating said control signal and a diode for applying said control signal to said semiconductor switching means.

2. An ignition timing controller for use in a breakerless ignition system for an internal combustion engine having a flywheel magneto, said controller comprising a semiconductor switching means to control a primary current through an ignition coil and a signal source to supply a control signal to said semiconductor switching means, characterized by that said signal source includes a plurality of signal generators to generate respective signal voltages having different phase angles, a voltage composing means comprising a variable core type transformer including an E-shaped stationary core including three leg portions and a movable core slidable along the tops of said three leg portions, two of said leg portions having input coils wound therearound with first ends commonly grounded and the other ends connected to said signal generator and the middle leg portion having an output coil wound therearound with one end grounded and with the other end connected to said semiconductor switching means through a diode.

3. An ignition timing controller as set forth in claim 2, wherein said movable core has sufficient length to magnetically couple two adjacent ones of said leg portions of said E-shaped core, said movable core associated with a throttle valve for slidable movement of said movable core on the tops of said leg portions.

* * * * *